US008099977B2

(12) United States Patent
Yamanaka et al.

(10) Patent No.: US 8,099,977 B2
(45) Date of Patent: Jan. 24, 2012

(54) REFRIGERANT CYCLE DEVICE

(75) Inventors: Masaji Yamanaka, Suwon-si (KR); Sung Oug Cho, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 989 days.

(21) Appl. No.: 12/073,812

(22) Filed: Mar. 10, 2008

(65) Prior Publication Data

US 2008/0245098 A1 Oct. 9, 2008

(30) Foreign Application Priority Data

Apr. 6, 2007 (KR) ..... 10-2007-0034442
Apr. 6, 2007 (KR) ..... 10-2007-0034443

(51) Int. Cl.
*F25B 41/00* (2006.01)

(52) U.S. Cl. ..... 62/513

(58) Field of Classification Search ..... 62/510, 62/512, 513
See application file for complete search history.

(56) References Cited

U.S. PATENT DOCUMENTS

| | | | | |
|---|---|---|---|---|
| 6,523,360 | B2 * | 2/2003 | Watanabe et al. | 62/204 |
| 7,225,635 | B2 * | 6/2007 | Matsumoto et al. | 62/513 |
| 2007/0000281 | A1 * | 1/2007 | Manole | 62/513 |

FOREIGN PATENT DOCUMENTS

| | | | |
|---|---|---|---|
| CN | 1862151 | A | 11/2006 |
| DE | 19944951 | A1 | 3/2001 |
| EP | 1961597 | A1 | 8/2008 |
| JP | 11-183062 | | 7/1999 |
| JP | 2002-130963 | | 5/2002 |
| JP | 2005-049026 | | 2/2005 |
| JP | 2005-337700 | | 12/2005 |
| JP | 2005-345074 | | 12/2005 |
| JP | 2006-97911 | | 4/2006 |
| JP | 2006-336943 | | 12/2006 |
| KR | 10-2006-0041722 | | 5/2006 |

OTHER PUBLICATIONS

Chinese Office Action for corresponding Chinese Patent Application No. 200810087352X dated May 8, 2009, 7 pgs.
European Search Report for corresponding European Patent Application No. 08152370.6 dated Mar. 19, 2010 (in English).
Japanese Office Action for corresponding Japanese Patent Application No. 2008-072449 dated Jun. 15, 2010.

* cited by examiner

*Primary Examiner* — Melvin Jones
(74) *Attorney, Agent, or Firm* — Staas & Halsey LLP

(57) ABSTRACT

A refrigerant cycle device capable of preventing inflow of a liquid refrigerant into a compressor and having a compact structure is disclosed. The refrigerant cycle device includes a compressor, a gas cooler, a pressure reducing device, an evaporator, and a heat exchanger to heat-exchange a refrigerant discharged from the gas cooler and a refrigerant discharged from the evaporator. The heat exchanger includes a first passage connected to an outlet of the gas cooler and a second passage connected to an outlet of the evaporator. The refrigerant in the first passage flows downward, and the refrigerant in the second passage flows upward.

18 Claims, 11 Drawing Sheets

REFRIGERANT CYCLE DEVICE

CROSS-REFERENCE TO RELATED APPLICATIONS

This application claims the benefit of Korean Patent Applications No. 10-2007-0034442, filed on Apr. 6, 2007 and 10-2007-0034443, filed on Apr. 6, 2007 in the Korean Intellectual Property Office, the disclosures of which are incorporated herein by reference.

BACKGROUND

1. Field

The present invention relates to a refrigerant cycle device, and more particularly to a refrigerant cycle device in which carbon dioxide is used as a refrigerant.

2. Description of the Related Art

A conventional refrigerant cycle device includes a refrigerant cycle configured such that a compressor, a gas cooler, a pressure reducing device (e.g., expansion valve) and an evaporator are sequentially pipe-connected to each other in a closed loop.

Freon (R11, R12, R134a, etc.) has been commonly used as a refrigerant of a refrigerant cycle device. However, because freon discharged in the atmosphere causes problems of global warming, disruption of the ozone layer and the like, there has been research related to the use of a natural refrigerant having little influence on the environment, e.g., oxygen (O2), carbon dioxide (CO2), hydrocarbon (HC), ammonia (NH3), or water (H2O) as a refrigerant.

Of the above natural refrigerants, because oxygen and water have low pressure, it is difficult to use these compounds as a refrigerant. Because ammonia and hydrocarbon are combustible, these materials are difficult to handle. Accordingly, there is being developed a device using a transcritical cycle in which carbon dioxide (CO2) is used as a refrigerant and a high pressure side is set to a supercritical pressure.

A transcritical cycle device is constituted such that an accumulator is mounted to a low pressure side between an outlet of an evaporator and a suction port of a compressor to prevent inflow of a liquid refrigerant into the compressor, and the liquid refrigerant is accumulated in the accumulator, so that only a gas refrigerant is sucked into the compressor.

However, the conventional refrigerant cycle device has problems such that the charging amount of refrigerant is increased due to the installation of the accumulator and the refrigerant cycle device cannot be made compact.

To solve the above problems, Korean Patent Laid-Open Publication No. 2006-0041722 discloses a refrigerant cycle device capable of preventing damage to a compressor due to liquid compression without installing an accumulator.

The above-disclosed refrigerant cycle device is a transcritical cycle device in which a compressor, a gas cooler, a pressure reducing device and an evaporator are connected to each other in a closed loop, carbon dioxide is used as a refrigerant, and a high pressure side is set to a supercritical pressure. The disclosed refrigerant cycle device includes an internal heat exchanger to heat-exchange a refrigerant discharged from the gas cooler and a refrigerant discharged from the evaporator. The internal heat exchanger includes a high pressure side passage through which the refrigerant discharged from the gas cooler flows, and a low pressure side passage through which the refrigerant discharged from the evaporator flows. The high pressure side passage and the low pressure side passage are arranged so as to be heat-exchanged with each other. The refrigerant in the high pressure side passage flows from down to up, and the refrigerant in the low pressure side passage flows from up to down.

By making the refrigerant in the high pressure side passage flow from down to up and the refrigerant in the low pressure side passage flow from up to down, a surplus refrigerant is accumulated in the high pressure side passage, and the amount of surplus refrigerant flowing into the low pressure side passage is reduced. Accordingly, the above-disclosed refrigerant cycle device shows an effect of preventing inflow of a liquid refrigerant into the compressor to a certain extent. However, if a large amount of surplus liquid refrigerant is included in the refrigerant flowing through the evaporator because a temperature around the evaporator is low, the inflow of the liquid refrigerant into the compressor cannot be perfectly prevented by the constitution such that the refrigerant from the evaporator flows from up to down in the low pressure side passage.

Also because the refrigerant in the high pressure side passage flows from down to up, the liquid refrigerant flowing to the expansion valve is evaporated, and flash gas is generated, which causes deterioration of the performance of the expansion valve.

Further, because a first refrigerant pipe and a second refrigerant pipe of the internal heat exchanger are spaced apart from each other, when the refrigerant flows through the internal heat exchanger or when vibration by the operation of the compressor is transmitted, the first refrigerant pipe of the internal heat exchanger vibrates to be contacted with the second refrigerant pipe, thereby generating noise. If the first and second refrigerant pipes get worn by the successive contact, operational reliability of the refrigerant cycle device is deteriorated.

Still further, when a temperature of the refrigerant at the outlet of the evaporator rises, a heat exchange area of the internal heat exchanger should be increased in order to achieve a sufficient heat exchange effect. To fulfill such a requirement, a length of the double pipe type internal heat exchanger should be increased, which results in increase in cost of the internal heat exchanger. There is also a limitation in improving the performance of the refrigeration cycle due to the insufficient heat exchange.

SUMMARY

Therefore, it is an aspect of the invention to provide a refrigerant cycle device which can prevent inflow of a liquid refrigerant into a compressor and can be manufactured compactly.

It is another aspect of the invention to provide a refrigerant cycle device using carbon dioxide as a refrigerant, which can reduce noise and improve reliability.

It is yet another aspect of the invention to provide a refrigerant cycle device which can improve heat exchange efficiency.

Additional aspects and/or advantages of the invention will be set forth in part in the description which follows and, in part, will be apparent from the description, or may be learned by practice of the invention.

The foregoing and/or other aspects of the present invention are achieved by providing a refrigerant cycle device comprising: a compressor; a gas cooler; a pressure reducing device; an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator. The heat exchanger includes a first passage connected to an outlet of the gas cooler and containing the refrigerant discharged from the gas cooler and a second passage connected to an outlet of the evaporator and containing the refrigerant discharged from the evaporator. The refrigerant in the first passage flows downward, and the refrigerant in the second passage flows upward.

The outlet of the evaporator may be disposed at a higher position than an inlet of the second passage.

The outlet of the evaporator may be connected to the inlet of the second passage by a refrigerant pipe which is inclined downward.

The heat exchanger may be formed in a double pipe type including a first refrigerant pipe and a second refrigerant pipe surrounding the first refrigerant pipe.

The first passage may be formed in the first refrigerant pipe, and the second passage may be formed between the first refrigerant pipe and the second refrigerant pipe.

The heat exchanger may be formed with bending portions with a predetermined interval therebetween, and the bending portions may be formed with contact portions between the first refrigerant pipe and the second refrigerant pipe.

The heat exchanger may have a substantially rectangular helical shape, and the contact portions may be formed at edge portions of the heat exchanger to prevent relative movement of the first refrigerant pipe and the second refrigerant pipe.

The refrigerant cycle device may use carbon dioxide as the refrigerant.

The refrigerant cycle device may further comprise an orifice provided in the second passage to change a flow rate of the refrigerant.

The orifice may be provided in the inlet of the second passage.

The foregoing and/or other aspects of the present invention are achieved by providing a refrigerant cycle device comprising: a compressor; a gas cooler; a pressure reducing device; an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator. The heat exchanger includes a first passage connected to an outlet of the gas cooler and containing the refrigerant discharged from the gas cooler and a second passage connected to an outlet of the evaporator and containing the refrigerant discharged from the evaporator. The first passage has an outlet and an inlet disposed at a higher position than the outlet of the first passage, and the second passage has an outlet and an inlet disposed at a lower position than the outlet of the second passage.

The inlet of the first passage may be positioned at the substantially same height as the outlet of the second passage, and the outlet of the first passage may be positioned at the substantially same height as the inlet of the second passage.

The refrigerant in the first passage may flow upward, and the refrigerant in the second passage may flow downward.

The outlet of the evaporator may be disposed at a higher position than the inlet of the second passage.

The heat exchanger may be formed in a double pipe type including a first refrigerant pipe and a second refrigerant pipe surrounding the first refrigerant pipe. The first passage may be formed in the first refrigerant pipe, and the second passage may be formed between the first refrigerant pipe and the second refrigerant pipe.

The refrigerant cycle device may further comprise an orifice to decrease a pressure of the refrigerant flowing through the second passage.

The heat exchanger may be formed with at least one contact portion between the first refrigerant pipe and the second refrigerant pipe to prevent relative movement of the first refrigerant pipe and the second refrigerant pipe.

The foregoing and/or other aspects of the present invention may be achieved by providing a refrigerant cycle device comprising: a compressor; a gas cooler; a pressure reducing device; an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator. The heat exchanger is a double pipe heat exchanger including a first refrigerant pipe, a second refrigerant pipe surrounding the first refrigerant pipe, and at least one contact portion between the first refrigerant pipe and the second refrigerant pipe. The refrigerant discharged from the gas cooler flows downward in the first refrigerant pipe, and the refrigerant discharged from the evaporator flows upward in the second refrigerant pipe.

In accordance with yet another aspect of the invention, there is provided a refrigerant cycle device comprising: a compressor; a gas cooler; a pressure reducing device; an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator. The heat exchanger is a double pipe heat exchanger including a first refrigerant pipe, a second refrigerant pipe surrounding the first refrigerant pipe, and an orifice defined by the first refrigerant pipe and the second refrigerant pipe to decrease a pressure of the refrigerant flowing between the first refrigerant pipe and the second refrigerant pipe.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
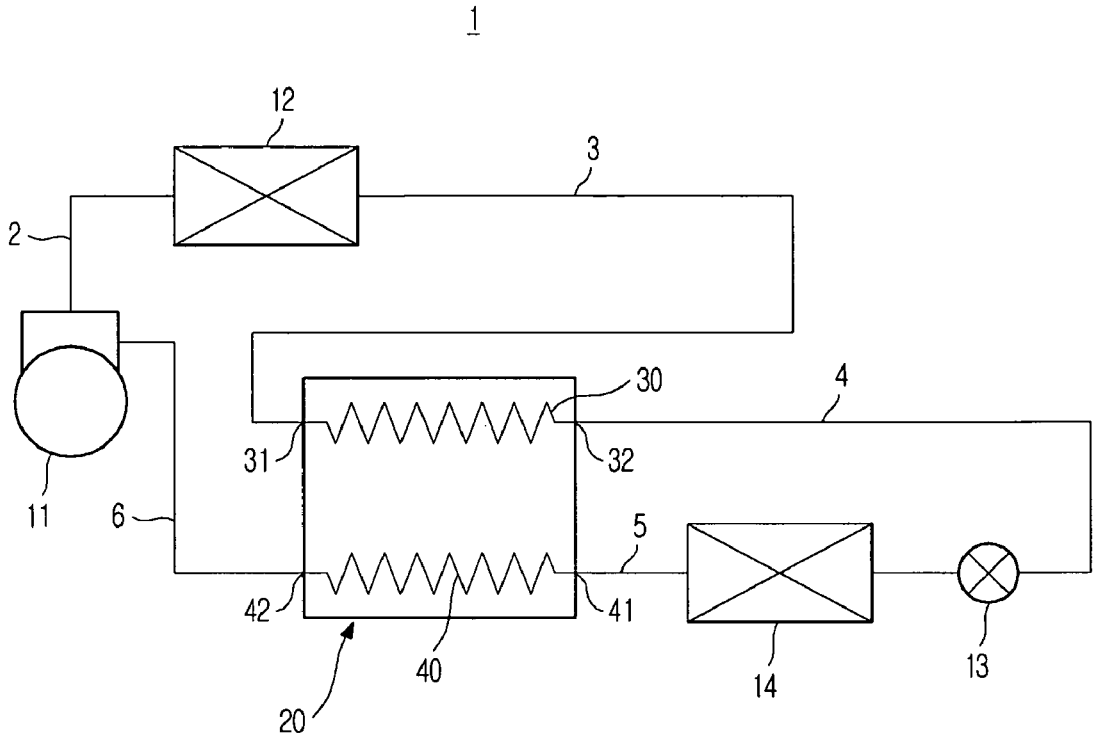
FIG. 1 is a refrigerant circuit diagram of a refrigerant cycle device in accordance with the first embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

FIG. 1 is a refrigerant circuit diagram of a refrigerant cycle device in accordance with a first embodiment of the present invention.

A refrigerant cycle device according to the embodiment of the present invention is used in an air conditioner, a refrigerator, a display case, or the like.

As shown in FIG. 1, a refrigerant cycle device 1 according to the first embodiment of the present invention is constituted such that a compressor 11, a gas cooler 12, an expansion valve 13 (pressure reducing device), and an evaporator 14 are connected to each other in a closed loop.

The compressor 11 is provided between the gas cooler 12 and the evaporator 14. The compressor 11 compresses a gas refrigerant of a low temperature and a low pressure into a gas refrigerant of a high temperature and a high pressure. Various types of compressors, such as a hermetic reciprocating compressor, a rotary compressor, a scroll compressor or the like, can be used.

An inlet of the gas cooler 12 is connected with a refrigerant discharge pipe 2 extending from the compressor 11. A pipe 3 connected with an outlet of the gas cooler 12 is connected to an inlet 31 of a first passage 30 forming a passage for a high pressure refrigerant in a heat exchanger 20.

The heat exchanger 20 heat-exchanges the high pressure refrigerant discharged from the gas cooler 12 and the low pressure refrigerant discharged from the evaporator 14. A pipe 4 connected with an outlet 32 of the first passage 30 of the heat exchanger 20 is connected to the evaporator 14 via the expansion valve 13. A pipe 5 connected with an outlet of the evaporator 14 is connected to an inlet 41 of a second passage 40 forming a passage for a low pressure refrigerant in the heat exchanger 20.

The refrigerant heated while flowing through the second passage 40 of the heat exchanger 20 is sucked into the compressor 11 through a refrigerant suction pipe 6, and circulates through the above refrigerant circuit of the refrigerant cycle device.

Figure 2:
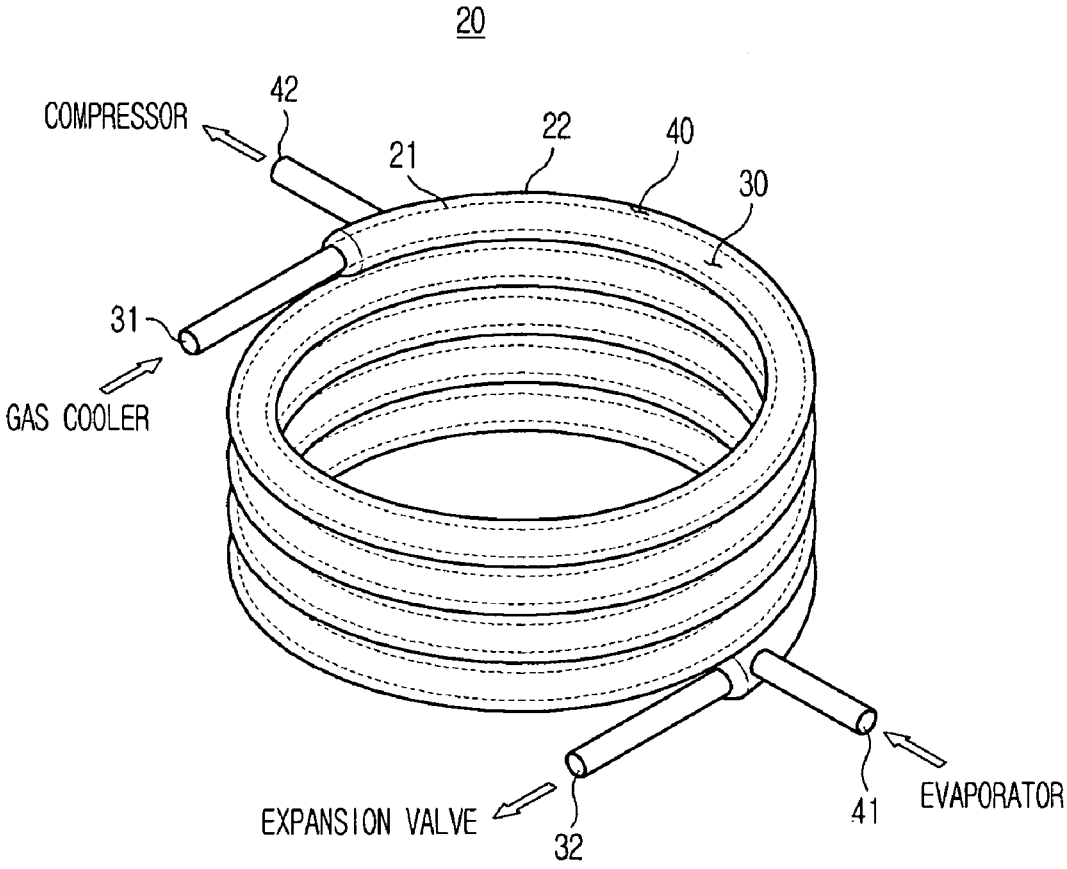
FIG. 2 is a perspective view illustrating a heat exchanger included in a refrigerant cycle device in accordance with the first embodiment of the present invention.
Figure 3:
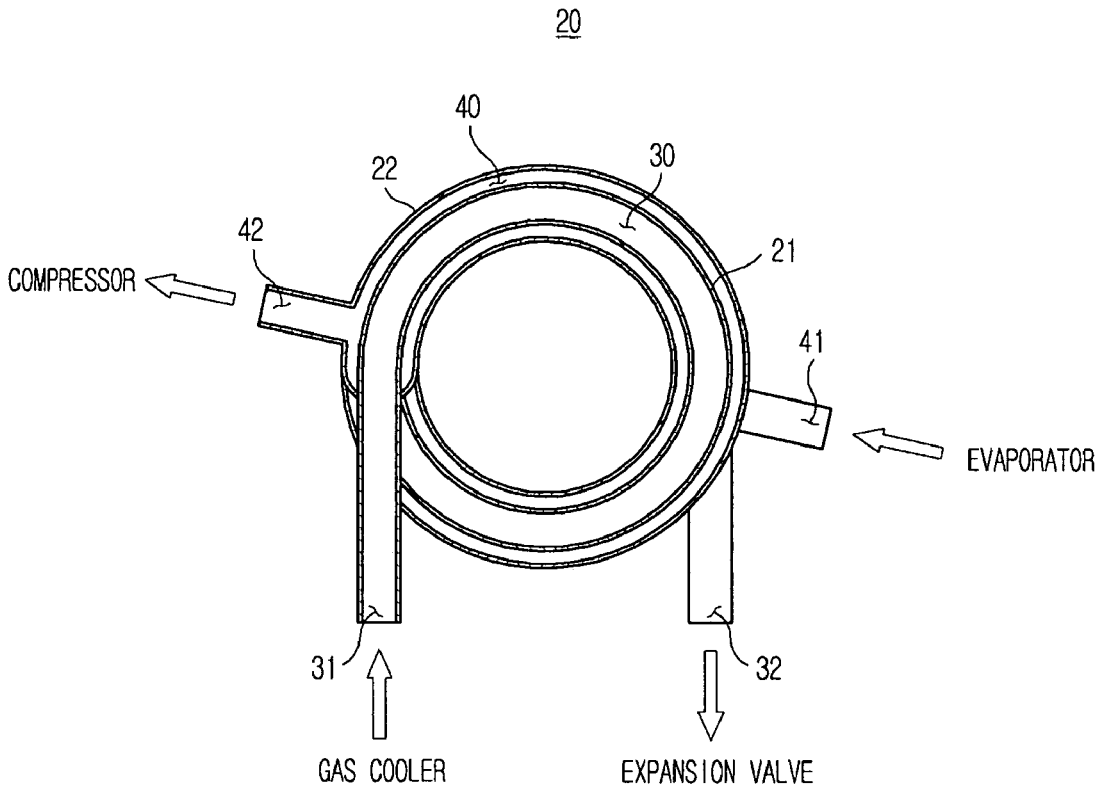
FIG. 3 is a schematic sectional view of the heat exchanger shown in FIG. 2.

FIG. 2 is a perspective view illustrating the heat exchanger included in the refrigerant cycle device according to the first embodiment of the present invention, and FIG. 3 is a schematic sectional view of the heat exchanger shown in FIG. 2.

As shown in FIGS. 2 and 3, the heat exchanger 20 is formed in a double pipe type including a first refrigerant pipe 21 and a second refrigerant pipe 22. The first refrigerant pipe 21 defines a first passage 30 thereinside, through which the high pressure refrigerant discharged from the gas cooler 12 flows. The first refrigerant pipe 21 and the second refrigerant pipe 22 define a second passage 40 therebetween, through which the low pressure refrigerant discharged from the evaporator 14 flows. In other words, the first passage 30 and the second passage 40 are arranged so that the refrigerant from the gas cooler 12 and the refrigerant from the evaporator 14 can be heat-exchanged with each other.

The double pipe type heat exchanger 20 may have a helical structure to increase a heat exchange area.

In order to make the refrigerant in the first passage 30 flow from up to down, an inlet 31 of the first passage 30 is formed at an upper portion of the heat exchanger 20, and an outlet 32 of the first passage 30 is formed at a lower portion of the heat exchanger 20. That is, the high pressure refrigerant discharged from the gas cooler 12 flows into the first passage 30 through the upper inlet 31, and flows out of the heat exchanger 20 through the lower outlet 32.

In order to make the refrigerant in the second passage 40 flow from down to up, an inlet 41 of the second passage 40 is formed at the lower portion of the heat exchanger 20, and an outlet 42 of the second passage 40 is formed at the upper portion of the heat exchanger 20. That is, the low pressure refrigerant discharged from the evaporator 14 flows into the second passage 40 through the lower inlet 41, and flows out of the heat exchanger 20 through the upper outlet 42.

Accordingly, since the refrigerant flowing through the first passage 30 and the refrigerant flowing through the second passage 40 flow in opposite directions, heat exchange efficiency of the heat exchanger 20 is enhanced.

Since the heat exchanger 20 of the refrigerant cycle device 1 according to the first embodiment is configured such that the refrigerant in the first passage 30 flows downward and the refrigerant in the second passage 40 flows upward, when a surplus liquid refrigerant is discharged from the evaporator 14, the second passage 40 of the heat exchanger 20 temporarily stores the liquid refrigerant in its lower portion, just like an accumulator. Accordingly, the inflow of the liquid refrigerant into the compressor 11 can be prevented without installing an additional accumulator, and the more stable refrigerant cycle device 1 can be achieved. Also, since the low temperature refrigerant flowing through the second passage 40 heat-exchanges with the high temperature refrigerant flowing through the first passage 30, even when the liquid refrigerant is discharged from the evaporator 14, the liquid refrigerant is totally phase-changed into a gas refrigerant, and the gas refrigerant is sucked into the compressor 11.

Because the refrigerant in the first passage 30 flows downward, the liquid refrigerant, which may be generated by a temperature condition of outdoor air in a supercritical state, gathers in a downstream side of the first passage 30, i.e., in the expansion valve 13. Therefore, the first passage 30 extending downward serves as a reservoir tank. As a result, the generation of a flash gas can be prevented. Further, since the refrigerant in the first passage 30 is cooled by being heat-exchanged with the refrigerant in the second passage 40, the generation of the flash gas can be further prevented, and thus the deterioration of performance of the expansion valve 13 can be prevented. As a result, the refrigerant cycle device can be operated stably.

In the refrigerant cycle device 1 according to the present invention, carbon dioxide (CO2), which is a natural refrigerant having environment-friendly, non-combustible and non-toxic features, is used as the refrigerant, and the high pressure side is set to a supercritical pressure.

The refrigerant introduced into the first passage 30 flows from up to down in the first passage 30. At this time, the refrigerant flowing in the first passage 30 is cooled by transferring heat to the refrigerant flowing in the second passage 40.

The high pressure refrigerant cooled in the heat exchanger 20 and discharged from the lower outlet 32 flows to the expansion valve 13. The refrigerant is converted into a gas/liquid two-phase refrigerant by a pressure drop in the expansion valve 13, and is introduced into the evaporator 14. While flowing through the evaporator 14, the refrigerant is evaporated, and absorbs heat from air, thereby performing a cooling action.

In the above process, since the temperature of the refrigerant flowing into the expansion valve 13 from the gas cooler 12 can be lowered by the heat exchanger 20, an entropy difference in the evaporator 14 is increased, and thus the cooling capacity of the evaporator 14 can be enhanced.

The refrigerant discharged from the evaporator is introduced into the inlet 41 of the second passage 40 formed between the first refrigerant pipe 21 and the second refrigerant pipe 22 of the heat exchanger 20, and flows from down to up in the second passage 40 between the first refrigerant pipe 21 and the second refrigerant pipe 22.

The low temperature refrigerant discharged from the evaporator 14 after being evaporated therein is not a perfect gas phase, but is a gas-liquid mixed phase. If the gas-liquid mixed refrigerant flows in the second passage 40 of the heat exchanger 20 and is heat-exchanged with the refrigerant flowing in the first passage 30, the gas-liquid mixed refrigerant is heated such that superheating of the refrigerant is obtained. Accordingly, the gas-liquid mixed refrigerant is converted into a perfect gas refrigerant. The gas refrigerant is discharged from the heat exchanger 20, and flows to a suction port of the compressor 11 via the refrigerant suction pipe 6.

Accordingly, the embodiments of the present invention can prevent the liquid refrigerant from being sucked into the compressor without installing an additional accumulator, and can keep the compressor from being broken.

As described above, by installing the heat exchanger 20 including the first passage 30 permitting the inflow of the refrigerant from the gas cooler 12 and the second passage 40 arranged in heat exchangeable relation with the first passage 30 and permitting the inflow of the refrigerant from the evaporator 14, the temperature of the refrigerant flowing into the expansion valve 13 from the gas cooler 12 is lowered, and the entropy difference in the evaporator 14 is increased, thereby enhancing the cooling capacity. Even when the heat radiation of the refrigerant is not achieved sufficiently in the gas cooler 12, the deterioration of performance of the expansion device due to the generation of a flash gas can be prevented by the heat exchanger 20.

Further, since the refrigerant discharged from the evaporator 14 is converted into a perfect gas refrigerant while flowing through the heat exchanger 20 and the liquid refrigerant is temporarily stored in the lower portion of the inlet of the second passage 40, it is unnecessary to install an accumulator to temporarily store the liquid refrigerant. Accordingly, the refrigerant cycle device can be made compact, and manufacturing costs can be saved.

Still further, since it is possible to accumulate the surplus refrigerant discharged from the first passage 30 in the expansion valve 13, the generation of a flash gas can be prevented.

The refrigerant cycle device according to the embodiment of the present invention as structured above has enhanced reliability and cooling capacity.

Although this embodiment has shown that the first passage is formed in the first refrigerant pipe and the second passage is formed between the first refrigerant pipe and the second refrigerant pipe, it can be modified such that the second passage is formed in the first refrigerant pipe and the first passage is formed between the first refrigerant pipe and the second refrigerant pipe.

The heat exchanger 20 is formed in a double-pipe structure including the first refrigerant pipe 21 and the second refrigerant pipe 22, however the heat exchanger 20 is not restricted thereto. The heat exchanger 20 may be formed in a structure of stacking steel plates having two passages thereinside.

Also in such a case, one passage defined as a first passage and the other passage defined as a second passage should be arranged in a heat exchangeable relation with each other. In addition, it should be configured such that the refrigerant in the first passage flows from up to down and the refrigerant in the second passage flows from down to up.

The pressure reducing device in this embodiment is configured as the expansion valve 13, however this is not restricted thereto. The pressure reducing device may be configured as an electric type or mechanical type expansion valve.

Next, the operation of the refrigerant cycle device 1 according to the first embodiment of the present invention as structured above will be explained.

Figure 4:
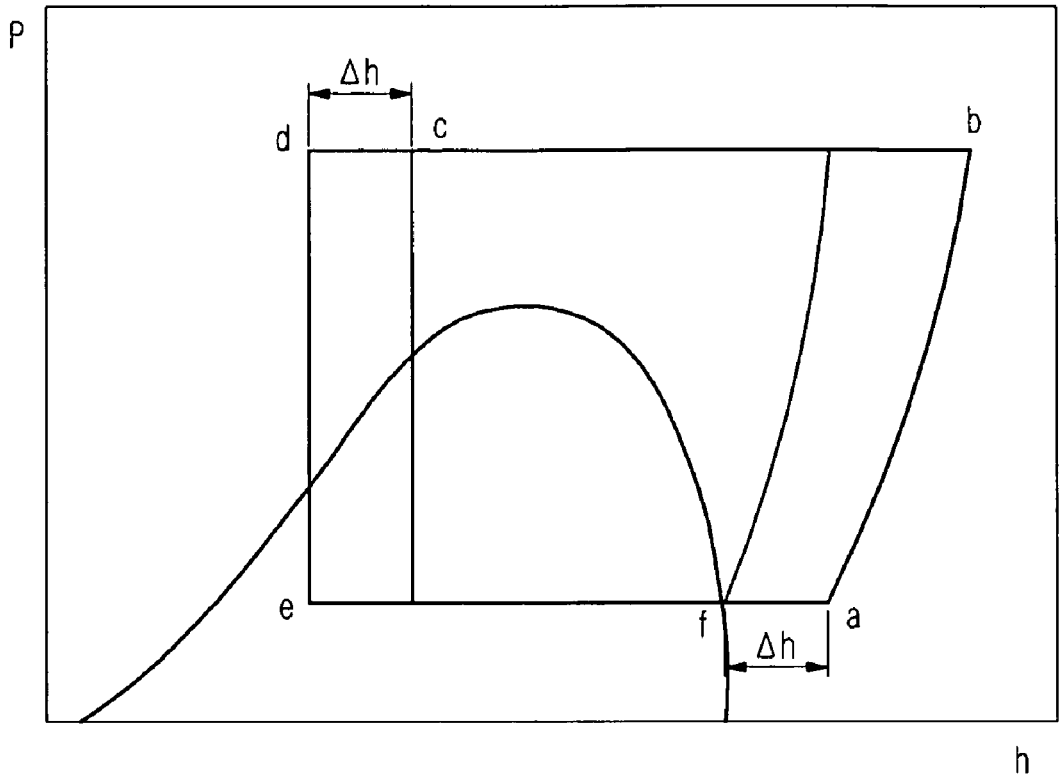
FIG. 4 is a p-h diagram of a refrigerant cycle of the refrigerant cycle device in accordance with the first embodiment of the present invention.

FIG. 4 is a p-h diagram of the refrigerant cycle of the refrigerant cycle device according to the first embodiment of the present invention.

In FIG. 4, the vertical axis refers to a pressure, and the horizontal axis refers to an enthalpy.

If the compressor 11 is driven, the low pressure gas refrigerant is sucked into the compressor 11, and is compressed into a gas refrigerant of high temperature and high pressure. At this time, the refrigerant is compressed to a supercritical pressure shown by a point "b" in FIG. 4. The gas refrigerant of high temperature and high pressure is discharged from the compressor 11.

The refrigerant of high temperature and high pressure is introduced into the gas cooler 12, and heat is radiated. The refrigerant is converted into a state shown by point "c" in FIG. 4, and flows into the inlet 31 of the first passage 30 of the heat exchanger 20. The refrigerant of high temperature and high pressure introduced into the heat exchanger 20 is cooled by being heat-exchanged with the refrigerant of low temperature and low pressure introduced into the second passage 40 from the evaporator 14, and is converted into a state shown by a point "d" in FIG. 4.

In other words, since the high pressure refrigerant flowing toward the expansion valve 13 from the gas cooler 12 is heat-exchanged with the low pressure refrigerant in the second passage 40 by the heat exchanger 20, the temperature of the high pressure refrigerant can be effectively decreased. Accordingly, an enthalpy of the refrigerant introduced into the expansion valve 13 drops by a value of Ah, and the refrigerant attains the state shown by point "d" in FIG. 4.

The high pressure refrigerant discharged from the heat exchanger 20 after being cooled in the heat exchanger 20 is introduced into the expansion valve 13. While flowing through the expansion valve 13, the pressure of the refrigerant drops, and the refrigerant is converted into a liquid/gas two-phase refrigerant as shown by point "e" in FIG. 4. Then, the refrigerant is introduced into the evaporator 14, and absorbs heat from air, thereby performing a cooling action.

Because the temperature of the refrigerant introduced into the evaporator 14 drops by the heat exchanging operation of the heat exchanger 20, the enthalpy difference in the evaporator 14 is increased, and thus the cooling capacity of the evaporator 14 can be enhanced.

The refrigerant discharged from the evaporator 14 is converted into a state shown by point "f" in FIG. 4, and flows into the inlet 41 of the second passage 40 of the heat exchanger 20. At this time, the low temperature refrigerant heat-exchanged in the evaporator 14 is in the liquid/gas two-phase state. Such a two-phase refrigerant is heat-exchanged while flowing through the second passage 40 of the heat exchanger 20, and is phase-changed into a perfect gas refrigerant as shown by point "a" in FIG. 4, thereby obtaining superheating. Accordingly, since only the gas refrigerant is introduced into the compressor 11, the problem of breakage of the compressor due to the inflow of the liquid refrigerant into the compressor can be prevented.

The refrigerant heated by the heat exchanger 20 is sucked into the compressor 11, and circulates through the above refrigerant circuit of the refrigerant cycle device.

As a result, in the refrigerant cycle device 1 according to the first embodiment of the present invention, both supercooling and superheating are increased. The increased supercooling prevents deterioration of performance of the evaporator 14, and the increased superheating prevents the inflow of the liquid refrigerant into the compressor 11, thereby enhancing the reliability of the compressor 11.

Hereinafter, a refrigerant cycle device according to a second embodiment of the present invention will be described.

The same elements as the first embodiment are denoted by the same reference numerals, and a detailed explanation thereof is omitted.

Figure 5:
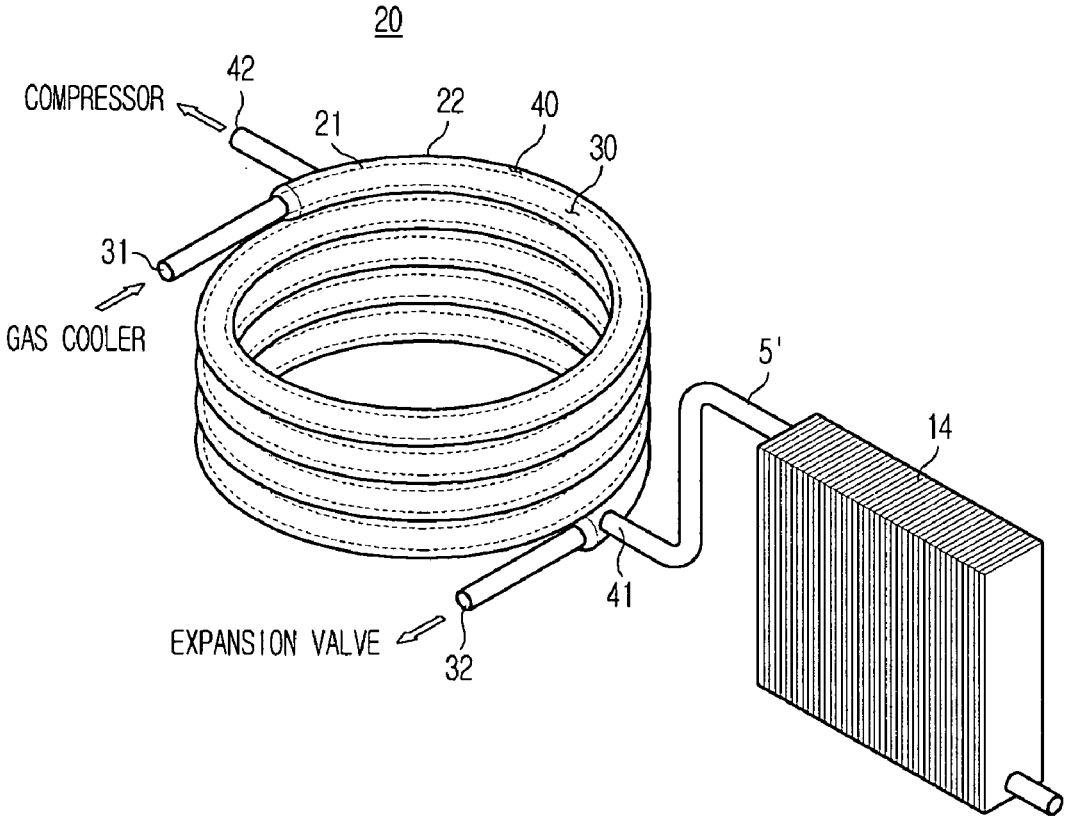
FIG. 5 is a schematic perspective view illustrating a connecting structure of a heat exchanger and an evaporator in a refrigerant cycle device in accordance with a second embodiment of the present invention.

FIG. 5 is a schematic perspective view illustrating a connecting structure of a heat exchanger and an evaporator in a refrigerant cycle device according to a second embodiment of the present invention.

A heat exchanger of the refrigerant cycle device according to the second embodiment is generally the same as the heat exchanger of the refrigerant cycle device according to the first embodiment.

However, the evaporator 14 and the heat exchanger 20 are arranged such that the outlet of the evaporator 14 is provided at a higher position than the inlet 41 of the second passage 40 of the heat exchanger 20. Specifically, the evaporator 14 and the heat exchanger 20 are arranged such that the outlet of the evaporator 14 is positioned at the substantially same height as the outlet 42 of the second passage 40.

Therefore, a refrigerant pipe 5' connecting the outlet of the evaporator 14 and the inlet 41 of the second passage 40 is inclined down toward the inlet 41 of the second passage 40.

By virtue of the above constitution, even when a large amount of surplus liquid refrigerant is discharged from the evaporator 14 because a temperature around the evaporator 14 is specifically low, the lower portion of the second passage 40 and the refrigerant pipe 5' between the outlet of the evaporator 14 and the inlet 41 of the second passage 40 serve as an accumulator. As a result, the effect of preventing breakage of the compressor can be more enhanced.

Hereinafter, a refrigerant cycle device according to a third embodiment of the present invention will be described.

The same elements as the second embodiment are denoted by the same reference numerals, and the detailed explanation thereof is omitted.

Figure 6:
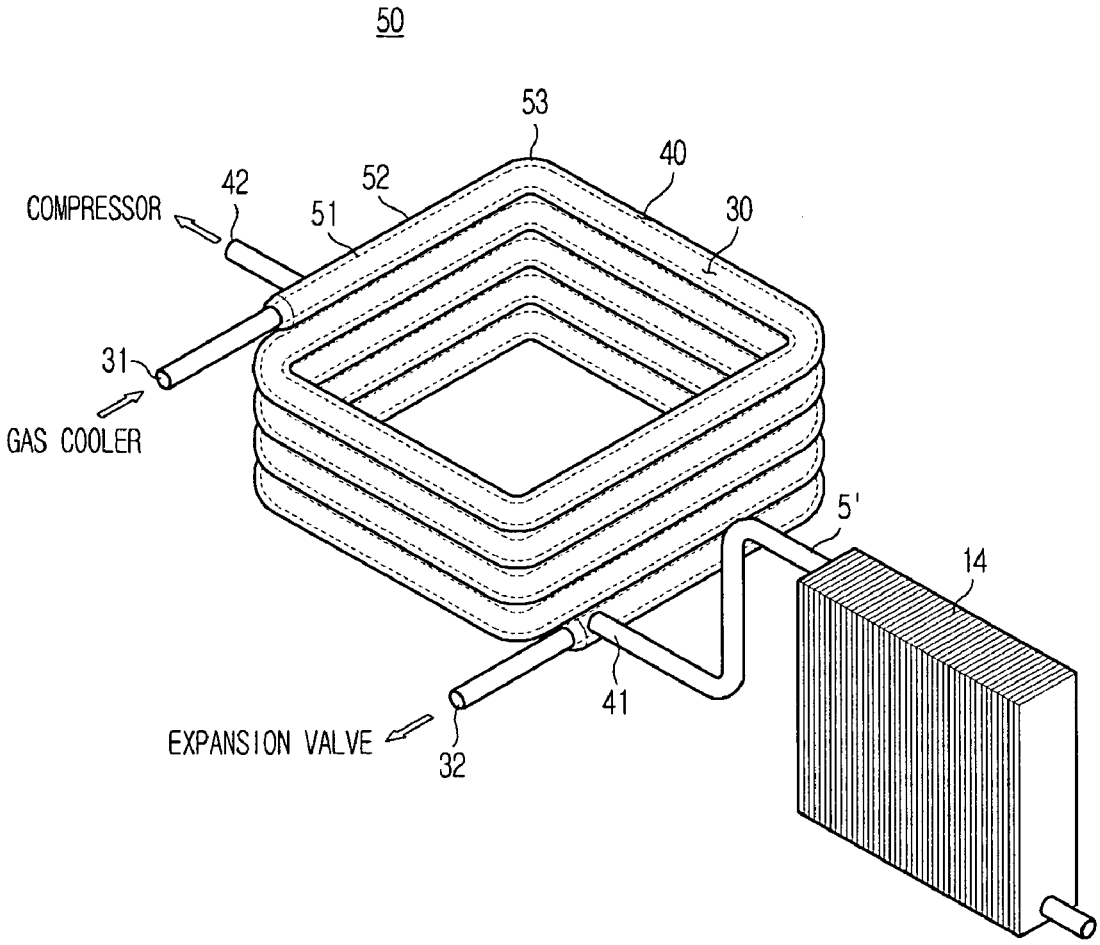
FIG. 6 is a schematic perspective view illustrating a connecting structure of a heat exchanger and an evaporator in a refrigerant cycle device in accordance with a third embodiment of the present invention.
Figure 7:
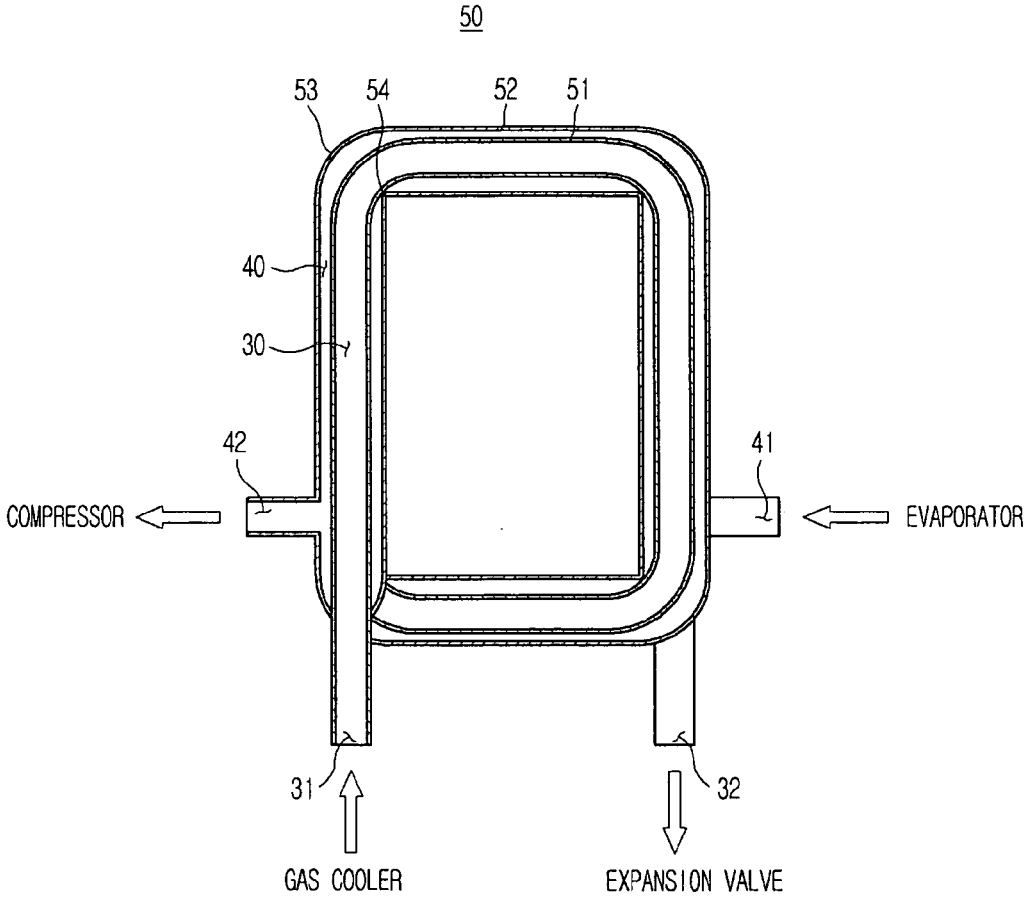
FIG. 7 is a schematic sectional view of the heat exchanger shown in FIG. 6.

FIG. 6 is a schematic perspective view illustrating a connecting structure of a heat exchanger and an evaporator in a refrigerant cycle device according to a third embodiment of the present invention, and FIG. 7 is a schematic sectional view of the heat exchanger shown in FIG. 6.

As shown in FIGS. 6 and 7, a heat exchanger 50 of this embodiment is formed in a double pipe type, and has a substantially rectangular helical structure. In order for the heat exchanger 50 to have a rectangular helical structure, the heat exchanger 50 is formed with bent portions 53 which are bent with a predetermined interval therebetween.

By the above configuration of bending the heat exchanger 50, double pipe type first and second refrigerant pipes 51 and 52 are contacted with each other at each bent portion 53, thereby forming a contact portion 54. In other words, the first refrigerant pipe 51 and the second refrigerant pipe 52 are contacted with each other at an inner portion of each bent portion 53 which is bent at a substantially right angle.

Accordingly, even when vibration is generated at the first and second refrigerant pipes 51 and 52 by the refrigerant flowing therein or the operation of the compressor 11, since the first and second refrigerant pipes 51 and 52 are kept in a fixed state through each contact portion 54, noise and wear due to relative movement of the first and second refrigerant pipes 51 and 52 can be prevented.

Except for the above structural features, the refrigerant cycle device according to the third embodiment has the same constitution and operational effects as the refrigerant cycle device according to the second embodiment.

Figure 8:
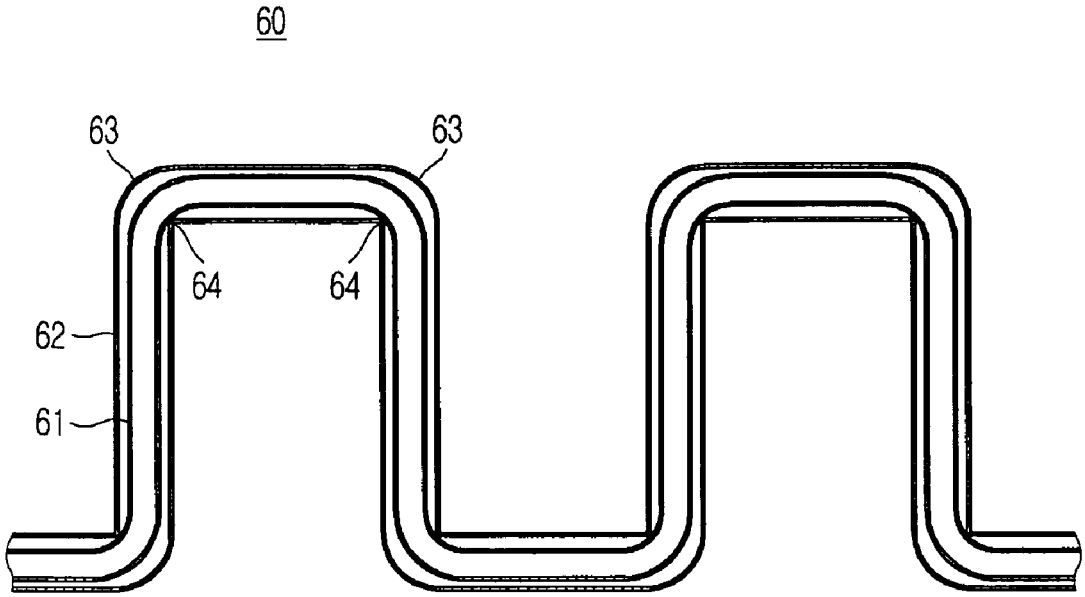
FIG. 8 is a schematic sectional view of a portion of a heat exchanger in accordance with a modified embodiment of the present invention.

Also, as shown in FIG. 8, a heat exchanger 60 can be configured such that a first refrigerant pipe 61 and a second refrigerant pipe 62 surrounding the first refrigerant pipe 61 are bent in a concave-convex shape. Accordingly, each of bent portions 63 of the concave-convex structure is formed with a contact portion 64, by which the relative movement of the first and second refrigerant pipes 61 and 62 are prevented. As a result, even when vibration is generated at the first and second refrigerant pipes 61 and 62, noise and wear due to the relative movement of the first and second refrigerant pipes 61 and 62 can be prevented.

Hereinafter, a refrigerant cycle device according to a fourth embodiment of the present invention will be described.

A refrigerant cycle device according to the fourth embodiment has the same refrigerant circuit as the refrigerant cycle device according to the first embodiment. The refrigerant cycle device according to the fourth embodiment has basically the same constitution as the first embodiment, except that a heat exchanger of the fourth embodiment has a substantially rectangular helical structure and an orifice is provided between a first refrigerant pipe and a second refrigerant pipe. The same elements as the first embodiment are denoted by the same reference numerals, and the detailed explanation thereof is omitted.

Figure 9:
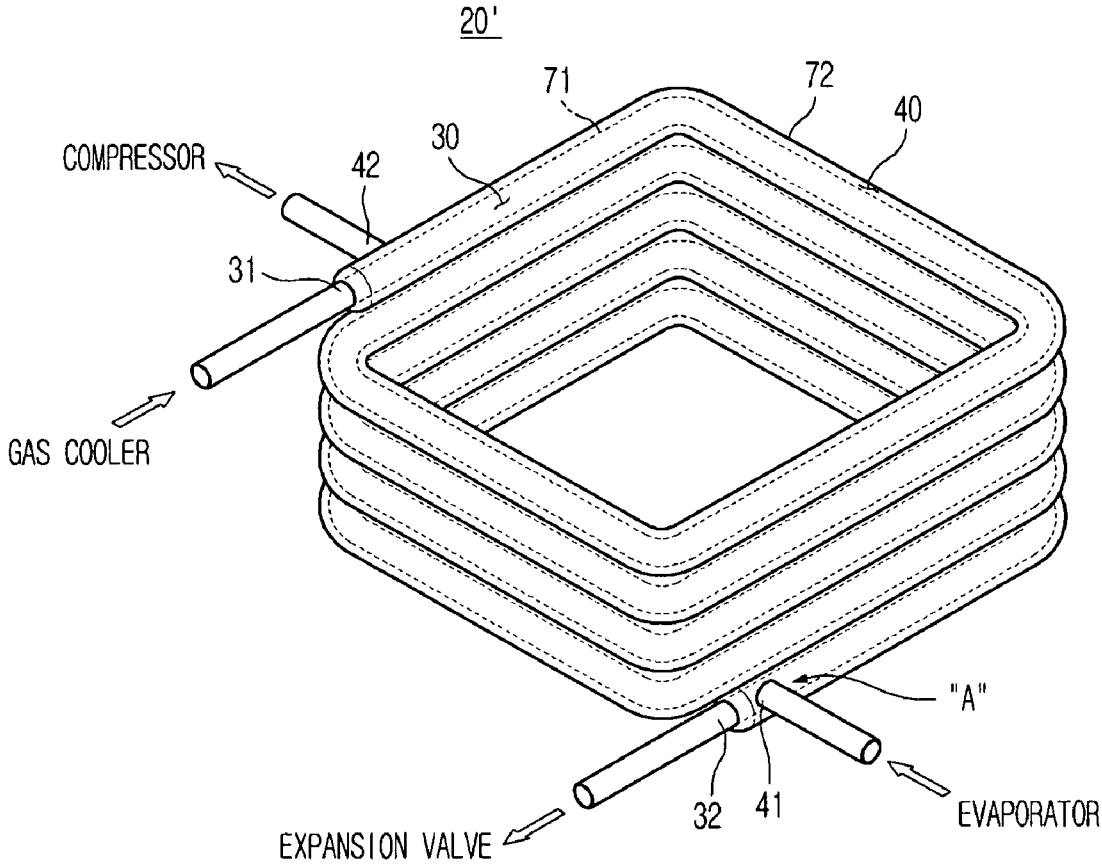
FIG. 9 is a perspective view illustrating a heat exchanger included in a refrigerant cycle device in accordance with a fourth embodiment of the present invention.
Figure 10:
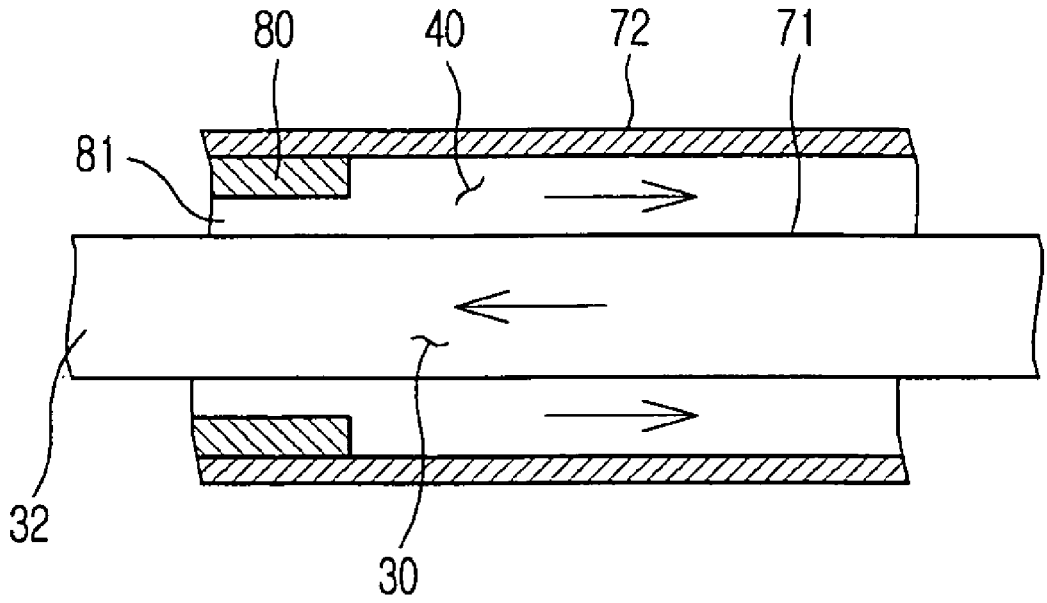
FIG. 10 is a sectional view of portion "A" in FIG. 9.

FIG. 9 is a perspective view illustrating a heat exchanger included in a refrigerant cycle device according to the fourth embodiment of the present invention, and FIG. 10 is a sectional view of portion "A" in FIG. 9.

A heat exchanger 20' of the fourth embodiment has a substantially rectangular helical shape. In order for the heat exchanger 20' to have a rectangular helical structure, the heat exchanger 20' is formed with bending portions which are bent with a predetermined interval therebetween.

An orifice 80 is provided in the second passage 40 formed between a first refrigerant pipe 71 and a second refrigerant pipe 72, to change a flow rate of the refrigerant.

The orifice 80 is provided at an inner surface of the second refrigerant pipe 72, and is positioned near the inlet 41 of the second passage 40 to reduce a sectional area of the inlet 41 of the second passage 40. Accordingly, the pressure of the refrigerant flowing through the orifice 80 drops.

Since the orifice 80 is provided at the inner surface of the second refrigerant pipe 72, while the refrigerant introduced into the second passage 40 flows through a small sectional area portion 81 formed by the orifice 80, the pressure of the refrigerant drops. Then, while flowing from down to up in the second passage 40 between the first refrigerant pipe 71 and the second refrigerant pipe 72, the refrigerant is heat-exchanged with the refrigerant in the first passage 30.

At this time, the low temperature refrigerant discharged from the evaporator 14 after being evaporated in the evaporator 14 is not a perfect gas refrigerant, but is a gas/liquid mixed refrigerant. The gas/liquid mixed refrigerant discharged from the evaporator 14 flows through the second passage 40 of the heat exchanger 20', and is heat-exchanged with the refrigerant flowing through the first passage 30. The refrigerant is heated such that the superheating of the refrigerant is obtained, and is converted into a perfect gas refrigerant. The gas refrigerant is discharged from the heat exchanger 20', and flows to the suction port of the compressor 11 via the refrigerant suction pipe 6.

The pressure of the refrigerant passing through the small sectional area portion 81 formed by the orifice 80 is decreased when compared to the related art. Accordingly, a pressure difference between the suction port and the discharge port of the compressor 11 becomes large, and thus the temperature of the refrigerant at the discharge port of the compressor becomes high.

By virtue of the above effect, when the refrigerant cycle device according to the embodiments of the present invention is applied to a water heater, the temperature of hot water can be increased, thereby enhancing the performance of the water heater.

Figure 11:
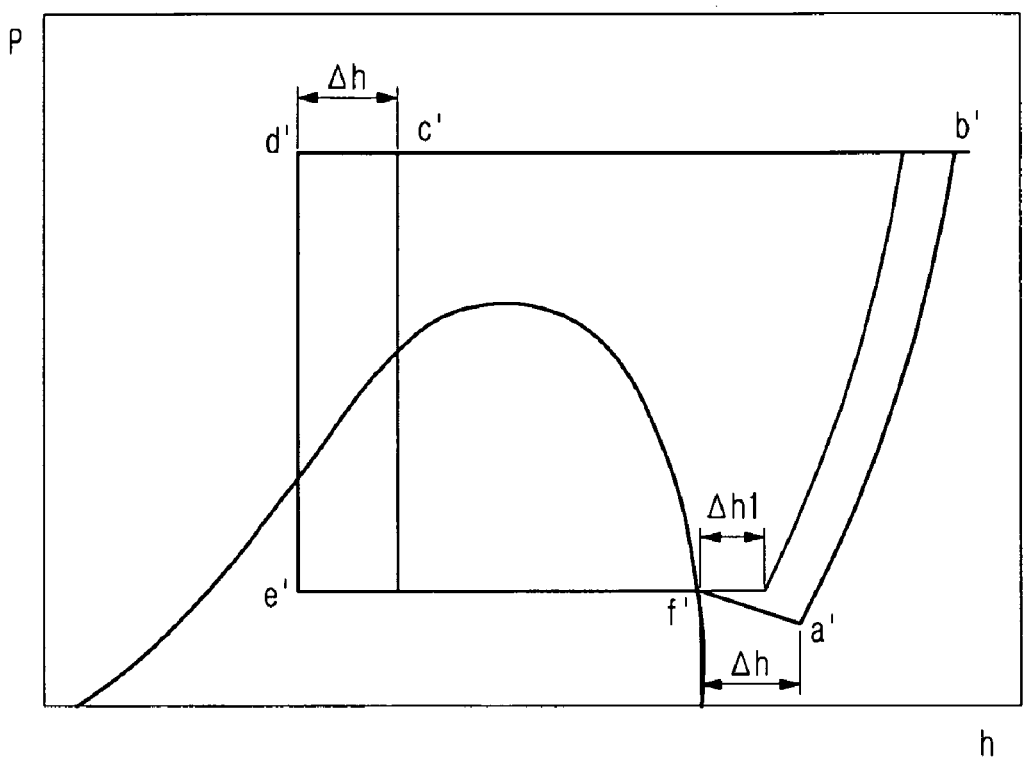
FIG. 11 is a p-h diagram of a refrigerant cycle of the refrigerant cycle device in accordance with the fourth embodiment of the present invention.

FIG. 11 is a p-h diagram of a refrigerant cycle of the refrigerant cycle device according to the fourth embodiment of the present invention.

In FIG. 11, a vertical axis refers to a pressure, and a horizontal axis refers to an enthalpy.

Next, the operation of the refrigerant cycle device according to the embodiments of the present invention as structured above will be explained with reference to FIGS. 1 and 9 to 11.

If the compressor 11 is driven, the low pressure gas refrigerant is sucked into the compressor 11, and is compressed into a gas refrigerant of high temperature and high pressure. At this time, the refrigerant is compressed to a supercritical pressure shown by point "b'" in FIG. 11. The gas refrigerant of high temperature and high pressure is discharged from the compressor 11.

The refrigerant of high temperature and high pressure is introduced into the gas cooler 12, and heat is radiated. The refrigerant is converted into a state shown by point "c'" in FIG. 11, and flows into the inlet 31 of the first passage 30 of the heat exchanger 20'. The refrigerant of high temperature and high pressure introduced into the heat exchanger 20' is cooled by being heat-exchanged with the refrigerant of low temperature and low pressure introduced into the second passage 40 from the evaporator 14, and is converted into a state shown by point "d'" in FIG. 11.

In other words, since the high pressure refrigerant flowing toward the expansion valve 13 from the gas cooler 12 is heat-exchanged with the low pressure refrigerant in the second passage 40 by the heat exchanger 20', the temperature of the high pressure refrigerant can be effectively decreased. Accordingly, an enthalpy of the refrigerant introduced into the expansion valve 13 drops by a value of Δh, and the refrigerant becomes the state shown by point "d'" in FIG. 11.

The high pressure refrigerant discharged from the heat exchanger 20' after being cooled in the heat exchanger 20' is introduced into the expansion valve 13. While flowing through the expansion valve 13, the pressure of the refrigerant drops, and the refrigerant is converted into a liquid/gas two-phase refrigerant as shown by point "e'" in FIG. 11. Then, the refrigerant is introduced into the evaporator 14, and absorbs heat from air, thereby performing a cooling action.

Because the temperature of the refrigerant introduced into the evaporator 14 drops by the heat exchanging operation of the heat exchanger 20', the enthalpy difference in the evaporator 14 is increased, and thus the cooling capacity of the evaporator 14 can be enhanced.

The refrigerant discharged from the evaporator 14 is converted into a state shown by point "f'" in FIG. 11, and flows into the inlet 41 of the second passage 40 of the heat exchanger 20'. While passing through the orifice 80 in the inlet 41 of the second passage 40, the pressure of the refrigerant drops. The liquid/gas two-phase refrigerant is heat-exchanged while flowing through the second passage 40 of the heat exchanger 20', and is phase-changed into a perfect gas refrigerant as shown by point "a'" in FIG. 11, thereby obtaining superheating. Since the refrigerant in the second passage 40, whose pressure drops while flowing through the orifice 80, is heat-exchanged with the refrigerant in the first passage 30, the enthalpy difference Δh is increased more than an enthalpy difference Δh1 in a heat exchanger of the related art. Accordingly, when compared to the related art, heat exchange efficiency is increased, and the heat exchanger with a shorter length can be manufactured, thereby saving manufacturing cost.

Also, since the pressure of the suction port of the compressor 11 is decreased by the refrigerant whose pressure is decreased while flowing through the orifice 80, a pressure difference between the suction port and the discharge port of the compressor 11 is increased when compared to the related art. Accordingly, the temperature of the refrigerant at the discharge port of the compressor 11 becomes high.

As a result, when the refrigerant cycle device according to the present invention is applied to a water heater, the temperature of hot water can be increased.

As apparent from the above description, the refrigerant cycle device according to the embodiments of the present invention can increase heat exchange efficiency without installing an additional accumulator and can be manufactured compactly with low cost, by heat-exchanging the refrigerant in the low pressure side passage and the refrigerant in the high pressure side passage in the heat exchanger while making the refrigerant in the low pressure side passage flow upward and the refrigerant in the high pressure side passage flow downward.

Further, since the outlet of the evaporator is disposed at a higher position than the inlet of the low pressure side passage of the heat exchanger, even when a large amount of surplus liquid refrigerant is discharged from the evaporator, the refrigerant pipe between the outlet of the evaporator and the inlet of the low pressure side passage serves as an accumulator. Accordingly, the inflow of the liquid refrigerant into the compressor can be prevented.

Further, since the double pipe type heat exchanger is formed with the contact portions between the first refrigerant pipe and the second refrigerant pipe, even when vibration is generated, noise and wear due to relative movement of the first and second refrigerant pipes can be prevented.

Still further, since the orifice is provided in the inlet of the second passage to decrease the pressure of the refrigerant flowing through the second passage, heat exchange efficiency of the heat exchanger can be improved, and the temperature at the discharge port of the compressor can be increased.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerant cycle device comprising:

a compressor;

a gas cooler;

a pressure reducing device;

an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator, the heat exchanger including a first passage connected to an outlet of the gas cooler and containing the refrigerant discharged from the gas cooler and a second passage connected to an outlet of the evaporator and containing the refrigerant discharged from the evaporator, wherein the refrigerant in the first passage flows downward, and the refrigerant in the second passage flows upward, and the outlet of the evaporator is disposed at a higher position than an inlet of the second passage.

2. The refrigerant cycle device according to claim 1, further comprising a refrigerant pipe, wherein the outlet of the evaporator is connected to an inlet of the second passage by the refrigerant pipe, and wherein the refrigerant pipe is inclined downward.

3. A refrigerant cycle device comprising:

a compressor;

a gas cooler;

a pressure reducing device;

an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator, the heat exchanger including a first passage connected to an outlet of the gas cooler and containing the refrigerant discharged from the gas cooler and a second passage connected to an outlet of the evaporator and containing the refrigerant discharged from the evaporator, wherein the refrigerant in the first passage flows downward, and the refrigerant in the second passage flows upward, and wherein the heat exchanger is a double pipe type heat exchanger including a first refrigerant pipe and a second refrigerant pipe surrounding the first refrigerant pipe.

4. The refrigerant cycle device according to claim 3, wherein the first passage is formed in the first refrigerant pipe, and the second passage is formed between the first refrigerant pipe and the second refrigerant pipe.

5. The refrigerant cycle device according to claim 3, wherein the heat exchanger comprises bent portions with a predetermined interval therebetween, and the bent portions are each formed with contact portions, at least one contact portion being in contact with the first refrigerant.

6. The refrigerant cycle device according to claim 5, wherein the heat exchanger has a substantially rectangular helical shape, and the contact portions are formed at edge portions of the heat exchanger to prevent relative movement of the first refrigerant pipe and the second refrigerant pipe.

7. The refrigerant cycle device according to claim 1, wherein the refrigerant is carbon dioxide.

8. A refrigerant cycle device comprising:

a compressor;

a gas cooler;

a pressure reducing device;

an evaporator, the compressor, the gas cooler, the pressure reducing device and the evaporator being in fluid communication to form a closed loop;

a heat exchanger to heat-exchange a refrigerant discharged from the gas cooler and a refrigerant discharged from the evaporator, the heat exchanger including a first passage connected to an outlet of the gas cooler and containing the refrigerant discharged from the gas cooler and a second passage connected to an outlet of the evaporator and containing the refrigerant discharged from the evaporator, the refrigerant in the first passage flowing downward, and the refrigerant in the second passage flowing upward; and an orifice provided in the second passage to change a flow rate of the refrigerant.

9. The refrigerant cycle device according to claim 8, wherein the orifice is provided in an inlet of the second passage.

10. A refrigerant cycle device comprising:

a compressor;

a gas cooler;

a pressure reducing device;

an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator, the heat exchanger including a first passage connected to an outlet of the gas cooler and containing the refrigerant discharged from the gas cooler and a second passage connected to an outlet of the evaporator and containing the refrigerant discharged from the evaporator, wherein the first passage has an outlet and an inlet disposed at a higher position than the outlet of the first passage, and the second passage has an outlet and an inlet disposed at a lower position than the outlet of the second passage.

11. The refrigerant cycle device according to claim 10, wherein the inlet of the first passage is positioned at a substantially same height as the outlet of the second passage, and the outlet of the first passage is positioned at a substantially same height as the inlet of the second passage.

12. The refrigerant cycle device according to claim 10, wherein the refrigerant in the first passage flows downward, and the refrigerant in the second passage flows upward.

13. The refrigerant cycle device according to claim 10, wherein the outlet of the evaporator is disposed at a higher position than the inlet of the second passage.

14. The refrigerant cycle device according to claim 10, wherein the heat exchanger is a double pipe type heat exchanger including a first refrigerant pipe and a second refrigerant pipe surrounding the first refrigerant pipe, the first passage is formed in the first refrigerant pipe, and the second passage is formed between the first refrigerant pipe and the second refrigerant pipe.

15. The refrigerant cycle device according to claim 10, further comprising:

an orifice defined in the second passage to decrease a pressure of the refrigerant flowing through the second passage.

16. A refrigerant cycle device comprising:

a compressor;

a gas cooler;

a pressure reducing device;

an evaporator; and a heat exchanger to heat-exchange a refrigerant discharged from the gas cooler and a refrigerant discharged from the evaporator, the heat exchanger being formed in a double pipe type including a first refrigerant pipe, a second refrigerant pipe surrounding the first refrigerant pipe, and at least one contact portion between the first refrigerant pipe and the second refrigerant pipe, wherein the refrigerant discharged from the gas cooler flows downward in the first refrigerant pipe, and the refrigerant discharged from the evaporator flows upward in the second refrigerant pipe.

17. A refrigerant cycle device comprising:

a compressor;

a gas cooler;

a pressure reducing device;

an evaporator, the compressor, the gas cooler, the pressure reducing device and the evaporator being in fluid communication to form a closed loop;

a heat exchanger to heat-exchange a refrigerant discharged from the gas cooler and a refrigerant discharged from the evaporator, the heat exchanger being a double pipe type heat exchanger including a first refrigerant pipe and a second refrigerant pipe surrounding the first refrigerant pipe; and a refrigerant pipe extending from an outlet of the evaporator to an inlet of the second refrigerant pipe with a downward inclination, wherein the refrigerant discharged from the gas cooler flows downward in the first refrigerant pipe, and the refrigerant discharged from the evaporator flows upward in the second refrigerant pipe.

18. A refrigerant cycle device comprising:

a compressor;

a gas cooler;

a pressure reducing device;

an evaporator, the compressor, the gas cooler, the pressure reducing device and the evaporator being in fluid communication to form a closed loop; and a heat exchanger to heat-exchange a refrigerant discharged from the gas cooler and a refrigerant discharged from the evaporator, the heat exchanger being a double pipe type heat exchanger including a first refrigerant pipe, a second refrigerant pipe surrounding the first refrigerant pipe, and an orifice defined by the first refrigerant pipe and the second refrigerant pipe to decrease a pressure of the refrigerant flowing between the first refrigerant pipe and the second refrigerant pipe, wherein the refrigerant discharged from the gas cooler flows downward in the first refrigerant pipe, and the refrigerant discharged from the evaporator flows upward in the second refrigerant pipe.

* * * * *